US008929515B2

(12) United States Patent
Liddiard

(10) Patent No.: US 8,929,515 B2
(45) Date of Patent: Jan. 6, 2015

(54) MULTIPLE-SIZE SUPPORT FOR X-RAY WINDOW

(75) Inventor: Steven D. Liddiard, Springville, UT (US)

(73) Assignee: Moxtek, Inc., Orem, UT (US)

( * ) Notice: Subject to any disclaimer, the term of this patent is extended or adjusted under 35 U.S.C. 154(b) by 317 days.

(21) Appl. No.: 13/312,531

(22) Filed: Dec. 6, 2011

(65) Prior Publication Data

US 2012/0213336 A1 Aug. 23, 2012

Related U.S. Application Data

(60) Provisional application No. 61/445,878, filed on Feb. 23, 2011.

(51) Int. Cl.
*H01J 35/18* (2006.01)
*G21K 1/02* (2006.01)

(52) U.S. Cl.
CPC .. *G21K 1/02* (2013.01); *H01J 35/18* (2013.01)
USPC ..... 378/140; 378/161

(58) Field of Classification Search
CPC ..... H01J 35/18; G21K 1/00; G21K 1/02
USPC ..... 378/140, 161
See application file for complete search history.

(56) References Cited

U.S. PATENT DOCUMENTS

| | | | |
|---|---|---|---|
| 1,276,706 | A | 5/1918 | Snook et al. |
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,340,363 | A | 2/1944 | Atlee et al. |
| 2,502,070 | A | 3/1950 | Atlee et al. |
| 2,663,812 | A | 3/1950 | Jamison et al. |
| 2,683,223 | A | 7/1954 | Hosemann |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

U.S. Appl. No. 13/018,667, filed Feb. 1, 2011; Robert C. Davis;; office action issued Apr. 26, 2012.

(Continued)

*Primary Examiner* — Glen Kao
(74) *Attorney, Agent, or Firm* — Thorpe North & Western LLP

(57) ABSTRACT

An x-ray window including a support frame with a perimeter and an aperture. A plurality of ribs can extend across the aperture of the support frame and can be supported or carried by the support frame. Openings exist between ribs to allow transmission of x-rays through such openings with no attenuation of x-rays by the ribs. A film can be disposed over and span the ribs and openings. The ribs can have at least two different cross-sectional sizes including at least one larger sized rib with a cross-sectional area that is at least 5% larger than a cross-sectional area of at least one smaller sized rib.

26 Claims, 10 Drawing Sheets

(56) References Cited

U.S. PATENT DOCUMENTS 2,952,790 A 9/1960 Steen
3,397,337 A 8/1968 Denholm
3,538,368 A 11/1970 Oess
3,665,236 A 5/1972 Gaines et al.
3,679,927 A 7/1972 Kirkendall
3,691,417 A 9/1972 Gralenski
3,741,797 A 6/1973 Chavasse, Jr. et al.
3,751,701 A 8/1973 Gralenski et al.
3,801,847 A 4/1974 Dietz
3,828,190 A 8/1974 Dahlin et al.
3,873,824 A * 3/1975 Bean et al. ..... 378/35
3,882,339 A 5/1975 Rate et al.
3,962,583 A 6/1976 Holland et al.
3,970,884 A 7/1976 Golden
4,007,375 A 2/1977 Albert
4,075,526 A 2/1978 Grubis
4,160,311 A 7/1979 Ronde et al.
4,163,900 A 8/1979 Warren et al.
4,178,509 A 12/1979 More et al.
4,184,097 A 1/1980 Auge
4,250,127 A 2/1981 Warren et al.
4,293,373 A 10/1981 Greenwood
4,368,538 A 1/1983 McCorkle
4,393,127 A * 7/1983 Greschner et al. ..... 430/5
4,443,293 A 4/1984 Mallon et al.
4,463,257 A 7/1984 Simpkins et al.
4,463,338 A 7/1984 Utner et al.
4,521,902 A 6/1985 Peugeot
4,532,150 A 7/1985 Endo et al.
4,573,186 A 2/1986 Reinhold
4,576,679 A 3/1986 White
4,584,056 A 4/1986 Perret et al.
4,591,756 A 5/1986 Avnery
4,608,326 A 8/1986 Neukermans et al.
4,645,977 A 2/1987 Kurokawa et al.
4,675,525 A 6/1987 Amingual et al.
4,679,219 A 7/1987 Ozaki
4,688,241 A 8/1987 Peugeot
4,696,994 A 9/1987 Nakajima
4,705,540 A 11/1987 Hayes
4,777,642 A 10/1988 Ono
4,797,907 A 1/1989 Anderton
4,818,806 A 4/1989 Kunimune et al.
4,819,260 A 4/1989 Haberrecker
4,862,490 A 8/1989 Karnezos et al.
4,870,671 A 9/1989 Hershyn
4,876,330 A 10/1989 Higashi et al.
4,878,866 A 11/1989 Mori et al.
4,885,055 A 12/1989 Woodbury et al.
4,891,831 A 1/1990 Tanaka et al.
4,933,557 A 6/1990 Perkins et al.
4,939,763 A 7/1990 Pinneo et al.
4,957,773 A 9/1990 Spencer et al.
4,960,486 A 10/1990 Perkins et al.
4,969,173 A 11/1990 Valkonet
4,979,198 A 12/1990 Malcolm et al.
4,979,199 A 12/1990 Cueman et al.
5,010,562 A 4/1991 Hernandez et al.
5,063,324 A 11/1991 Grunwald et al.
5,066,300 A 11/1991 Isaacson et al.
5,077,771 A 12/1991 Skillicorn et al.
5,077,777 A 12/1991 Daly
5,090,046 A 2/1992 Friel
5,105,456 A 4/1992 Rand et al.
5,117,829 A 6/1992 Miller et al.
5,153,900 A 10/1992 Nomikos et al.
5,161,179 A 11/1992 Suzuki et al.
5,173,612 A 12/1992 Imai et al.
5,196,283 A 3/1993 Ikeda et al.
5,217,817 A 6/1993 Verspui et al.
5,226,067 A * 7/1993 Allred et al. ..... 378/161
RE34,421 E 10/1993 Parker et al.
5,258,091 A 11/1993 Imai et al.
5,267,294 A 11/1993 Kuroda et al.
5,302,523 A 4/1994 Coffee et al.
5,343,112 A 8/1994 Wegmann
5,391,958 A 2/1995 Kelly
5,392,042 A 2/1995 Pellon
5,400,385 A 3/1995 Blake et al.
5,422,926 A 6/1995 Smith et al.
5,428,658 A 6/1995 Oettinger et al.
5,432,003 A 7/1995 Plano et al.
5,465,023 A 11/1995 Garner
5,469,429 A 11/1995 Yamazaki et al.
5,469,490 A 11/1995 Golden et al.
5,478,266 A 12/1995 Kelly
5,521,851 A 5/1996 Wei et al.
5,524,133 A 6/1996 Neale et al.
5,561,342 A 10/1996 Roeder et al.
RE35,383 E 11/1996 Miller et al.
5,571,616 A 11/1996 Phillips et al.
5,578,360 A 11/1996 Viitanen
5,602,507 A 2/1997 Suzuki
5,607,723 A 3/1997 Plano et al.
5,621,780 A 4/1997 Smith et al.
5,627,871 A 5/1997 Wang
5,631,943 A 5/1997 Miles
5,673,044 A 9/1997 Pellon
5,680,433 A 10/1997 Jensen
5,682,412 A 10/1997 Skillicorn et al.
5,696,808 A 12/1997 Lenz
5,706,354 A 1/1998 Stroehlein
5,729,583 A 3/1998 Tang et al.
5,740,228 A 4/1998 Schmidt et al.
5,774,522 A 6/1998 Warburton
5,812,632 A 9/1998 Schardt et al.
5,835,561 A 11/1998 Moorman et al.
5,870,051 A 2/1999 Warburton
5,898,754 A 4/1999 Gorzen
5,907,595 A 5/1999 Sommerer
6,002,202 A 12/1999 Meyer et al.
6,005,918 A 12/1999 Harris et al.
6,044,130 A 3/2000 Inazura et al.
6,062,931 A 5/2000 Chuang et al.
6,063,629 A 5/2000 Knoblauch
6,069,278 A 5/2000 Chuang
6,073,484 A 6/2000 Miller et al.
6,075,839 A 6/2000 Treseder
6,097,790 A 8/2000 Hasegawa et al.
6,129,901 A 10/2000 Moskovits et al.
6,133,401 A 10/2000 Jensen
6,134,300 A 10/2000 Trebes et al.
6,184,333 B1 2/2001 Gray
6,205,200 B1 3/2001 Boyer et al.
6,277,318 B1 8/2001 Bower
6,282,263 B1 8/2001 Arndt et al.
6,288,209 B1 9/2001 Jensen
6,307,008 B1 10/2001 Lee et al.
6,320,019 B1 11/2001 Lee et al.
6,351,520 B1 2/2002 Inazaru
6,385,294 B2 5/2002 Suzuki et al.
6,388,359 B1 5/2002 Duelli et al.
6,438,207 B1 8/2002 Chidester et al.
6,477,235 B2 11/2002 Chornenky et al.
6,487,272 B1 11/2002 Kutsuzawa
6,487,273 B1 11/2002 Takenaka et al.
6,494,618 B1 12/2002 Moulton
6,546,077 B2 4/2003 Chornenky et al.
6,567,500 B2 5/2003 Rother
6,645,757 B1 11/2003 Okandan et al.
6,646,366 B2 11/2003 Hell et al.
6,658,085 B2 12/2003 Sklebitz
6,661,876 B2 12/2003 Turner et al.
6,740,874 B2 5/2004 Doring
6,778,633 B1 8/2004 Loxley et al.
6,799,075 B1 9/2004 Chornenky et al.
6,803,570 B1 10/2004 Bryson, III et al.
6,816,573 B2 11/2004 Hirano et al.
6,819,741 B2 11/2004 Chidester
6,838,297 B2 1/2005 Iwasaki
6,852,365 B2 2/2005 Smart et al.
6,866,801 B1 3/2005 Mau et al.
6,876,724 B2 4/2005 Zhou
6,900,580 B2 5/2005 Dai et al.

(56) References Cited

U.S. PATENT DOCUMENTS

| | | | |
|---|---|---|---|
| 6,956,706 | B2 | 10/2005 | Brandon |
| 6,962,782 | B1 | 11/2005 | Livache et al. |
| 6,976,953 | B1 | 12/2005 | Pelc |
| 6,987,835 | B2 | 1/2006 | Lovoi |
| 7,035,379 | B2 | 4/2006 | Turner et al. |
| 7,046,767 | B2 | 5/2006 | Okada et al. |
| 7,049,735 | B2 | 5/2006 | Ohkubo et al. |
| 7,075,699 | B2 | 7/2006 | Oldham et al. |
| 7,085,354 | B2 | 8/2006 | Kanagami |
| 7,108,841 | B2 | 9/2006 | Smally |
| 7,130,380 | B2 | 10/2006 | Lovoi et al. |
| 7,130,381 | B2 | 10/2006 | Lovoi et al. |
| 7,189,430 | B2 | 3/2007 | Ajayan et al. |
| 7,203,283 | B1 | 4/2007 | Puusaari |
| 7,206,381 | B2 | 4/2007 | Shimono et al. |
| 7,215,741 | B2 | 5/2007 | Ukita |
| 7,224,769 | B2 | 5/2007 | Turner |
| 7,233,071 | B2 | 6/2007 | Furukawa et al. |
| 7,233,647 | B2 | 6/2007 | Turner et al. |
| 7,286,642 | B2 | 10/2007 | Ishikawa et al. |
| 7,305,066 | B2 | 12/2007 | Ukita |
| 7,358,593 | B2 | 4/2008 | Smith et al. |
| 7,382,862 | B2 | 6/2008 | Bard et al. |
| 7,399,794 | B2 | 7/2008 | Harmon et al. |
| 7,410,603 | B2 | 8/2008 | Noguchi et al. |
| 7,428,298 | B2 | 9/2008 | Bard et al. |
| 7,448,801 | B2 | 11/2008 | Oettinger et al. |
| 7,448,802 | B2 | 11/2008 | Oettinger et al. |
| 7,486,774 | B2 | 2/2009 | Cain |
| 7,526,068 | B2 | 4/2009 | Dinsmore |
| 7,529,345 | B2 | 5/2009 | Bard et al. |
| 7,618,906 | B2 | 11/2009 | Meilahti |
| 7,634,052 | B2 | 12/2009 | Grodzins |
| 7,649,980 | B2 | 1/2010 | Aoki et al. |
| 7,650,050 | B2 | 1/2010 | Haffner et al. |
| 7,657,002 | B2 | 2/2010 | Burke et al. |
| 7,680,652 | B2 | 3/2010 | Giesbrecht et al. |
| 7,684,545 | B2 | 3/2010 | Damento et al. |
| 7,693,265 | B2 | 4/2010 | Hauttmann et al. |
| 7,709,820 | B2 | 5/2010 | Decker et al. |
| 7,737,424 | B2 | 6/2010 | Xu et al. |
| 7,756,251 | B2 | 7/2010 | Davis et al. |
| 2002/0075999 | A1 | 6/2002 | Rother |
| 2002/0094064 | A1 | 7/2002 | Zhou |
| 2003/0096104 | A1 | 5/2003 | Tobita et al. |
| 2003/0152700 | A1 | 8/2003 | Asmussen et al. |
| 2003/0165418 | A1 | 9/2003 | Ajayan et al. |
| 2004/0076260 | A1 | 4/2004 | Charles, Jr. et al. |
| 2005/0018817 | A1 | 1/2005 | Oettinger et al. |
| 2005/0141669 | A1 | 6/2005 | Shimono et al. |
| 2005/0207537 | A1 | 9/2005 | Ukita |
| 2006/0073682 | A1 | 4/2006 | Furukawa et al. |
| 2006/0098778 | A1 | 5/2006 | Oettinger et al. |
| 2006/0233307 | A1 | 10/2006 | Dinsmore |
| 2006/0269048 | A1 | 11/2006 | Cain |
| 2007/0025516 | A1 | 2/2007 | Bard et al. |
| 2007/0087436 | A1 | 4/2007 | Miyawaki et al. |
| 2007/0111617 | A1 | 5/2007 | Meilahti |
| 2007/0133921 | A1 | 6/2007 | Haffner et al. |
| 2007/0142781 | A1 | 6/2007 | Sayre |
| 2007/0165780 | A1 | 7/2007 | Durst et al. |
| 2007/0176319 | A1 | 8/2007 | Thostenson et al. |
| 2007/0183576 | A1 | 8/2007 | Burke et al. |
| 2008/0199399 | A1 | 8/2008 | Chen et al. |
| 2008/0296479 | A1 | 12/2008 | Anderson et al. |
| 2008/0296518 | A1 | 12/2008 | Xu et al. |
| 2008/0317982 | A1 | 12/2008 | Hecht |
| 2009/0085426 | A1 | 4/2009 | Davis et al. |
| 2009/0086923 | A1 | 4/2009 | Davis et al. |
| 2009/0173897 | A1* | 7/2009 | Decker et al. ..... 250/505.1 |
| 2010/0096595 | A1 | 4/2010 | Prud'Homme et al. |
| 2010/0126660 | A1 | 5/2010 | O'Hara |
| 2010/0140497 | A1 | 6/2010 | Damiano, Jr. et al. |
| 2010/0239828 | A1 | 9/2010 | Cornaby et al. |
| 2010/0243895 | A1 | 9/2010 | Xu et al. |
| 2010/0248343 | A1 | 9/2010 | Aten et al. |
| 2010/0285271 | A1 | 11/2010 | Davis et al. |
| 2010/0323419 | A1 | 12/2010 | Aten et al. |
| 2011/0017921 | A1 | 1/2011 | Jiang et al. |
| 2011/0089330 | A1 | 4/2011 | Thoms |

FOREIGN PATENT DOCUMENTS

| | | |
|---|---|---|
| DE | 19818057 | 11/1999 |
| EP | 0297808 | 1/1989 |
| EP | 0330456 | 8/1989 |
| EP | 0400655 | 5/1990 |
| EP | 0676772 | 3/1995 |
| GB | 1252290 | 11/1971 |
| JP | 57082954 | 8/1982 |
| JP | S6074253 | 1/1985 |
| JP | S6089054 | 5/1985 |
| JP | 3170673 | 7/1991 |
| JP | 05066300 | 3/1993 |
| JP | 5135722 | 6/1993 |
| JP | 06119893 | 7/1994 |
| JP | 6289145 | 10/1994 |
| JP | 6343478 | 12/1994 |
| JP | 8315783 | 11/1996 |
| JP | 2001179844 | 7/2001 |
| JP | 2003/007237 | 1/2003 |
| JP | 2003/088383 | 3/2003 |
| JP | 2003510236 | 3/2003 |
| JP | 2003/3211396 | 7/2003 |
| JP | 4171700 | 6/2006 |
| JP | 2006297549 | 11/2006 |
| KR | 10-2005-0107094 | 11/2005 |
| WO | WO 96-19738 | 6/1996 |
| WO | WO 99/65821 | 12/1999 |
| WO | WO 00/09443 | 2/2000 |
| WO | WO 00/17102 | 3/2000 |
| WO | WO 03/076951 | 9/2003 |
| WO | WO 2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |

OTHER PUBLICATIONS

Anderson et al., U.S. Appl. No. 11/756,962, filed Jun. 1, 2007.

Barkan et al., "Improved window for low-energy x-ray transmission a Hybrid design for energy-dispersive microanalysis," Sep. 1995, 2 pages, Ectroscopy 10(7).

Blanquart et al.; "XPAD, a New Read-out Pixel Chip for X-ray Counting"; IEEE Xplore; Mar. 25, 2009.

Chen, Xiaohua et al., "Carbon-nanotube metal-matrix composites prepared by electroless plating," Composites Science and Technology, 2000, pp. 301-306, vol. 60.

Comfort, J. H., "Plasma-enhanced chemical vapor deposition of in situ doped epitaxial silicon at low temperatures," J. Appl. Phys. 65, 1067 (1989).

Das, D. K., and K. Kumar, "Chemical vapor deposition of boron on a beryllium surface," Thin Solid Films, 83(1), 53-60.

Das, K., and Kumar, K., "Tribological behavior of improved chemically vapor-deposited boron on beryllium," Thin Solid Films, 108(2), 181-188.

Flahaut, E. et al, "Carbon Nanotube-metal-oxide nanocomposites; microstructure, electrical conductivity and mechanical properties," Acta mater., 2000, pp. 3803-3812.Vo. 48.

Gevin, et al IDe-XV1.0: Performances of a New CMOS Multi channer Analogue Readout ASIC for Cd (Zn) Te Detectors; IEEE 2005.

Grybos et al.; "DEDIX—Development of Fully Integrated Multichannel ASIC for High Count Rate Digital X-ray Imagining systems"; IEEE 2006; Nuclear Science Symposium Conference Record.

Grybos, "Pole-Zero Cancellations Circuit With Pulse Pile-Up Tracking System for Low Noise Charge-Sensitive Amplifiers"; Mar. 25, 2009; from IEEE Xplore.

Grybos, et al "Measurements of Matching and High Count Rate Performance of Multichannel ASIC for Digital X-Ray Imaging Systems"; IEEE Transactions on Nuclear Science, vol. 54, No. 4, 2007.

(56) References Cited

OTHER PUBLICATIONS

Hanigofsky, J. A., K. L. More, and W. J. Lackey, "Composition and microstructure of chemically vapor-deposited boron nitride, aluminum nitride, and boron nitride + aluminum nitride composites," J. Amer. Ceramic Soc. 74, 301 (1991).
http://www.orau.org/ptp/collection/xraytubescollidge/MachelettCW250.htm, 1999, 2 pgs.
Hutchison, "Vertically aligned carbon nanotubes as a framework for microfabrication of high aspect ration mems," 2008, pp. 1-50.
Jiang, et al; "Carbon nanotubes-metal nitride composites: a new class of nanocomposites with enhanced electrical properties"; Jun. 25, 2004 ; J. Mater. Chem, 2005.
Jiang, Linquin et al., "Carbon nanotubes-metal nitride composites; a new class of nanocomposites with enhanced electrical properties," J. Mater. Chem., 2005, pp. 260-266, vol. 15.
Komatsu, S., and Y. Moriyoshi, "Influence of atomic hydrogen on the growth reactions of amorphous boron films in a low-pressure B.sub.2 H.sub.6 +He+H.sub.2 plasma", J. Appl. Phys. 64, 1878 (1988).
Komatsu, S., and Y. Moriyoshi, "Transition from amorphous to crystal growth of boron films in plasma-enhanced chemical vapor deposition with B.sub.2 H.sub.6 +He," J. Appl. Phys., 66, 466 (1989).
Komatsu, S., and Y. Moriyoshi, "Transition from thermal-to electron-impact decomposition of diborane in plasma-enhanced chemical vapor deposition of boron films from B.sub.2 H.sub.6 +He," J. Appl. Phys. 66, 1180 (1989).
Lee, W., W. J. Lackey, and P. K. Agrawal, "Kinetic analysis of chemical vapor deposition of boron nitride," J. Amer. Ceramic Soc. 74, 2642 (1991).
Li, Jun et al., "Bottom-up approach for carbon nanotube interconnects," Applied Physics Letters, Apr. 14, 2003, pp. 2491-2493, vol. 82 No. 15.
Lines, U.S. Appl. No. 12/352,864, filed Jan. 13, 2009.
Lines, U.S. Appl. No. 12/726,120, filed Mar. 17, 2010.
Ma. R.Z., et al., "Processing and properties of carbon nanotubes-nano-SIC ceramic", Journal of Materials Science 1998, pp. 5243-5246, vol. 33.
Maya, L., and L. A. Harris, "Pyrolytic deposition of carbon films containing nitrogen and/or boron," J. Amer. Ceramic Soc. 73, 1912 (1990).
Michaelidis, M., and R. Pollard, "Analysis of chemical vapor deposition of boron," J. Electrochem. Soc. 132, 1757 (1985).
Micro X-ray Tube Operation Manual, X-ray and Specialty Instruments Inc., 1996, 5 pages.
Moore, A. W., S. L. Strong, and G. L. Doll, "Properties and characterization of codeposited boron nitride and carbon materials," J. Appl. Phys. 65, 5109 (1989).
Nakamura, K., "Preparation and properties of amorphous boron nitride films by molecular flow chemical vapor deposition," J. Electrochem. Soc. 132, 1757 (1985).
Panayiotatos, et al., "Mechanical performance and growth characteristics of boron nitride films with respect to their optical, compositional properties and density," Surface and Coatings Technology, 151-152 (2002) 155-159.
Peigney, et al., "Carbon nanotubes in novel ceramic matrix nanocomposites," Ceramics International, 2000, pp. 677-683, vol. 26.
Perkins, F. K., R. A. Rosenberg, and L. Sunwoo, "Synchrotronradiation deposition of boron and boron carbide films from boranes and carboranes: decaborane," J. Appl. Phys. 69,4103 (1991).
Powell et al., "Metalized polyimide filters for x-ray astronomy and other applications," SPIE, pp. 432-440, vol. 3113.
Rankov. A. "A Novel Correlated Double Sampling Poly-Si Circuit for Readout System in Large Area X-Ray Sensors", 2005.
Roca i Cabarrocas, P., S. Kumar, and B. Drevillon, "In situ study of the thermal decomposition of B.sub.2 H.sub.6 by combining spectroscopic ellipsometry and Kelvin probe measurements," J. Appl. Phys. 66, 3286 (1989).
Satishkumar B.C., et al. "Synthesis of metal oxide nanorods using carbon nanotubes as templates," Journal of Materials Chemistry, 2000, pp. 2115-2119, vol. 10.
Scholze et al., "Detection efficiency of energy-dispersive detectors with low-energy windows" X-Ray Spectrometry, X-Ray Spectrom, 2005: 34: 473-476.
Sheather, "The support of thin windows for x-ray proportional counters," Journal Phys,E., Apr. 1973, pp. 319-322, vol. 6, No. 4.
Shirai, K., S.-I. Gonda, and S. Gonda, "Characterization of hydrogenated amorphous boron films prepared by electron cyclotron resonance plasma chemical vapor deposition method," J. Appl. Phys. 67, 6286 (1990).
Tamura, et al "Developmenmt of ASICs for CdTe Pixel and Line Sensors", IEEE Transactions on Nuclear Science, vol. 52, No. 5, Oct. 2005.
Tien-Hui Lin et al., "An investigation on the films used as teh windows of ultra-soft X-ray counters." Acta Physica Sinica, vol. 27, No. 3, pp. 276-283, May 1978, abstract only.
U.S. Appl. No. 12/640,154, filed Dec. 17, 2009, Krzysztof Kozaczek.
U.S. Appl. No. 12/726,120, filed Mar. 17, 2010, Michael Lines.
U.S. Appl. No. 12/783,707, filed May 20, 2010, Steven D. Liddiard.
U.S. Appl. No. 12/899,750, filed Oct. 7, 2010, Steven Liddiard.
U.S. Appl. No. 13/018,667, filed Feb. 1, 2011, Lei Pei.
Vandenbulcke, L. G., "Theoretical and experimental studies on the chemical vapor deposition of boron carbide," Indust. Eng. Chem. Prod. Res. Dev. 24, 568 (1985).
Viitanen Veli-Pekka et al., Comparison of Ultrathin X-Ray Window Designs, presented at the Soft X-rays in the 21st Century Conference held in Provo, Utah Feb. 10-13, 1993, pp. 182-190.
Wagner et al, "Effects of Scatter in Dual-Energy Imaging: An Alternative Analysis"; IEEE; Sep. 1989, vol. 8. No. 3.
Winter, J., H. G. Esser, and H. Reimer, "Diborane-free boronization," Fusion Technol. 20, 225 (1991).
www.moxtek,com, Moxtek, Sealed Proportional Counter X-Ray Windows, Oct. 2007, 3 pages.
www.moxtek.com, Moxtek, AP3 Windows, Ultra-thin Polymer X-Ray Windows, Sep. 2006, 2 pages.
www.moxtek.com, Moxtek, DuraBeryllium X-Ray Windows, May. 2007, 2 pages.
www.moxtek.com, Moxtek, ProLine Series 10 Windows, Ultra-thin Polymer X-Ray Windows, Sep. 2006, 2 pages.
www.moxtek.com, X-Ray Windows, ProLINE Series 20 Windows Ultra-thin Polymer X-ray Windows, 2 pages. Applicant believes that this product was offered for sale prior to the filed of applicant's application.
Yan, Xing-Bin, et al., Fabrications of Three-Dimensional ZnO-Carbon Nanotube (CNT) Hybrids Using Self-Assembled CNT Micropatterns as Framework, 2007. pp. 17254-17259, vol. III.
Nakajima et al.; "Trial use of carbon-fiber-reinforced plastic as a non-Bragg window material of x-ray transmission"; Rev. Sci. Instrum 60 (7), Jul. 1989.
Coleman, et al.; "Small but strong: A review of the mechanical properties of carbon nanotube-polymer composites"; Carbon 44 (2006) 1624-1652.
Najafi, et al.; "Radiation resistant polymer-carbon nanotube nanocomposite thin films"; Department of Materials Science and Engineering . . . Nov. 21, 2004.
Wang, et al.; "Highly oriented carbon nanotube papers made of aligned carbon nanotubes"; Tsinghua-Foxconn Nanotechnology Research Center and Department of Physics; Published Jan. 31, 2008.
Xie, et al.; "Dispersion and alignment of carbon nanotubes in polymer matrix: A review"; Center for Advanced Materials Technology; Apr. 20, 2005.
Wu, et al.; "Mechanical properties and thermo-gravimetric analysis of PBO thin films"; Advanced Materials Laboratory, Institute of Electro-Optical Engineering; Apr. 30, 2006.
Coleman, et al.; "Mechanical Reinforcement of Polymers Using Carbon Nanotubes"; Adv. Mater. 2006, 18, 689-706.
Zhang, et al.; "Superaligned Carbon Nanotube Grid for High Resolution Transmission Electron Microscopy of Nanomaterials"; 2008 American Chemical Society.
Hu, et al.; "Carbon Nanotube Thin Films: Fabrication, Properties, and Applications"; 2010 American Chemical Society Jul. 22, 2010.
NEYCO, "SEM & TEM: Grids"; catalog; http://www.neyco.fr/pdf/Grids.pdf#page=1.

(56) References Cited

OTHER PUBLICATIONS

Hexcel Corporation; "Prepreg Technology" brochure; http://www.hexcel.com/Reso2882urces/DataSheets/Brochure-Data-Sheets/Prepreg_Technology.pdf.
Chakrapani et al.; Capillarity-Driven Assembly of Two-Dimensional Cellular Carbon Nanotube Foams; PNAS; Mar. 23, 2004; pp. 4009-4012; vol. 101; No. 12.
Nakajima et al; Trial Use of Carbon-Fiber-Reinforced Plastic as a Non-Bragg Window Material of X-Ray Transmission; Rev. Sci. Instrum.; Jul. 1989; pp. 2432-2435; vol. 60, No. 7.
Vajtai ; Building Carbon Nanotubes and Their Smart Architecture; pp. 691-698; 2002.
U.S. Appl. No. 13/307,579, filed Nov. 30, 2011, Dongbing Wang.
U.S. Appl. No. 13/312,531, filed Dec. 6, 2011, Steven Liddiard.
U.S. Appl. No. 12/899,750, filed Oct. 7, 2010; Steven Liddiard; office action dated Oct. 15, 2012.
U.S. Appl. No. 13/018,667, filed Feb. 1, 2011; Robert C. Davis; office action dated Oct. 2, 2012.
PCT application EP12167551.6; filed May 10, 2012; Robert C. Davis; European search report mailed Nov. 21, 2013.

* cited by examiner

MULTIPLE-SIZE SUPPORT FOR X-RAY WINDOW

CLAIM OF PRIORITY

This claims priority to U.S. Provisional Patent Application Ser. No. 61/445,878, filed Feb. 23, 2011, which is incorporated herein by reference in its entirety.

BACKGROUND

X-ray windows can be used for enclosing an x-ray source or detection device. The window can be used to separate air from a vacuum within the enclosure while allowing passage of x-rays through the window.

X-ray windows can include a thin film supported by a support structure, typically comprised of ribs supported by a frame. The support structure can be used to minimize sagging or breaking of the thin film. The support structure can interfere with the passage of x-rays and thus it can be desirable for ribs to be as thin or narrow as possible while still maintaining sufficient strength to hold the thin film. The support structure is normally expected to be strong enough to withstand a differential pressure of around 1 atmosphere without sagging or breaking.

Information relevant to x-ray windows can be found in U.S. Pat. Nos. 4,933,557, 7,737,424, 7,709,820, 7,756,251 and U.S. patent application Ser. Nos. 11/756,962, 12/783,707, 13/018,667, 61/408,472 all incorporated herein by reference.

SUMMARY

It has been recognized that it would be advantageous to provide a support structure for an x-ray window that is strong but also minimizes attenuation of x-rays. The present invention is directed to an x-ray window that satisfies the need for strength and minimal attenuation of x-rays by providing larger ribs for strength of the overall structure which support smaller ribs. The smaller ribs allow for reduced attenuation of x-rays. The x-ray window can comprise a support frame with a perimeter and an aperture. A plurality of ribs can extend across the aperture of the support frame and can be supported or carried by the support frame. Openings exist between ribs to allow transmission of x-rays through such openings with no attenuation of x-rays by the ribs. A film can be disposed over and span the ribs and openings. The film can be configured to pass radiation therethrough, such as by selecting a film material and thickness for optimal transmission of x-rays. The ribs can have at least two different cross-sectional sizes including at least one larger sized rib with a cross-sectional area that is at least 5% larger than a cross-sectional area of at least one smaller sized rib.

DEFINITIONS

Figure 1:
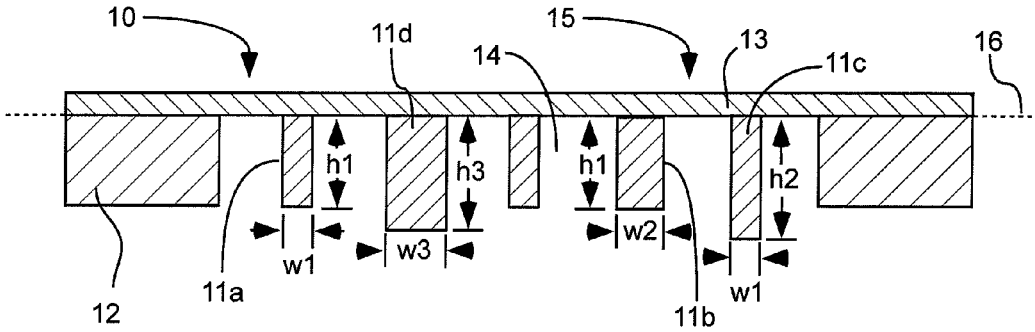
FIG. 1 is a schematic cross-sectional side view of an x-ray window, showing a thin film supported by a support structure, in accordance with an embodiment of the present invention.

As used herein, the term "about" is used to provide flexibility to a numerical range or value by providing that a given value may be "a little above" or "a little below" the endpoint.

As used herein, the term rib "cross-sectional area" means the rib width times the rib height.

As used herein, the term "linear" or "linearly", as referring to the rib pattern, means that the rib or ribs extends substantially straight, without bends or curves, as the rib extends across the aperture of the support frame. "Non-linear" means that the rib does bend or curve.

As used herein, the terms "larger ribs," "larger rib," "largest ribs," and "largest rib" mean larger or largest in cross-sectional area of the ribs, and does not refer to the length of the ribs.

As used herein, the terms "smaller ribs," "smaller rib," "smallest ribs," and "smallest rib" mean smaller or smallest in cross-sectional area of the ribs, and does not refer to the length of the ribs.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, an x-ray window 10 is shown comprising a support frame 12 with a perimeter and an aperture 15. A plurality of ribs 11 can extend across the aperture 15 of the support frame 12 and can be supported or carried by the support frame 12. Openings 14 exist between ribs 11 to allow transmission of x-rays through such openings with no attenuation of x-rays by the ribs 11. A film 13 can be disposed over and span the ribs 11 and openings 14. The film 13 can be carried by the ribs 11. The film 13 can contact the ribs 11.

The film 13 can be configured to pass radiation therethrough, such as by selecting a film material and thickness for optimal transmission of x-rays. The ribs 11 can have at least two different cross-sectional sizes including at least one larger sized rib with a cross-sectional area that is at least 5% larger than a cross-sectional area of at least one smaller sized rib. This design with some ribs having a larger cross sectional area and other ribs having a smaller cross sectional area can have high strength provided by the larger ribs while allowing for minimal attenuation of x-rays by use of smaller ribs.

The change in cross-sectional area between larger and smaller ribs can be accomplished by a change in rib width w and/or a change in rib height h. For example, in FIG. 1, rib 11*b* has a width w2 that is greater than a width w1 of rib 11*a*, but both ribs have approximately equal heights h1, and thus rib 11*b* has a greater cross-sectional area than rib 11*a*. As another example, rib 11*c* has a height h2 that is greater than a height h1 of rib 11*a*, but both ribs have approximately equal widths w1, and thus rib 11*c* has a greater cross-sectional area than rib 11*a*. As another example, rib 11*d* has a height h3 that is greater than a height h1 of rib 11*a* and a width w3 that is greater than a width w1 of rib 11*a*, and thus rib 11*d* has a greater cross-sectional area than rib 11*a*. As another example not shown, one rib may have a greater width, but a lesser height, than another rib. Whichever rib has a greater value of width times height has a greater cross-sectional area.

In the various embodiments described herein, tops of the ribs 11 can terminate substantially in a common plane 16. "Tops of the ribs" is defined as the location on the ribs 11 to which the film 13 is attached. It can be beneficial for tops of the ribs 11 to terminate substantially in a common plane 16 to allow for a substantially flat film 13.

FIGS. 2-9 show schematic top views of x-ray window support structures, with some ribs having a larger cross-sectional area and other ribs having a smaller cross-sectional area. Ribs with a smallest cross-sectional area are designated as 11*e*, ribs with a larger cross-sectional area than ribs 11*e* are designated as 11*f*, ribs with a larger cross-sectional area than ribs 11*f* are designated as 11*g*, ribs with a larger cross-sectional area than ribs 11*g* are designated as 11*h*, and ribs with a larger cross-sectional area than ribs 11*h* are designated as 11*i*. Ribs with larger cross-sectional area are shown with wider lines. A wider line does not necessarily mean that the rib is wider, only that the cross-sectional area is larger, which may be accomplished by a larger width, a larger height, or both, than another rib.

In one embodiment, each larger sized rib can have a cross-sectional area that is at least 5% larger than a cross-sectional area of smaller sized ribs $$\frac{\text{Area of larger rib} - \text{Area of smaller rib}}{\text{Area of smaller rib}} > 0.05.$$

In another embodiment, each larger sized rib can have a cross-sectional area that is at least 10% larger than a cross-sectional area of smaller sized ribs. In another embodiment, each larger sized rib can have a cross-sectional area that is at least 25% larger than a cross-sectional area of smaller sized ribs. In another embodiment, each larger sized rib can have a cross-sectional area that is at least 50% larger than a cross-sectional area of smaller sized ribs. In another embodiment, each larger sized rib can have a cross-sectional area that is at least twice as large as a cross-sectional area of smaller sized ribs. In another embodiment, each larger sized rib can have a cross-sectional area that is at least four times as large as a cross-sectional area of smaller sized ribs.

Some figures show only two different cross-sectional area size ribs, but more cross-sectional area sizes are within the scope of the present invention and are only excluded from the figures for simplicity. Also, more than the five different cross-sectional area size ribs shown are within the scope of the present invention and are only excluded from the figures for simplicity.

Figure 2:
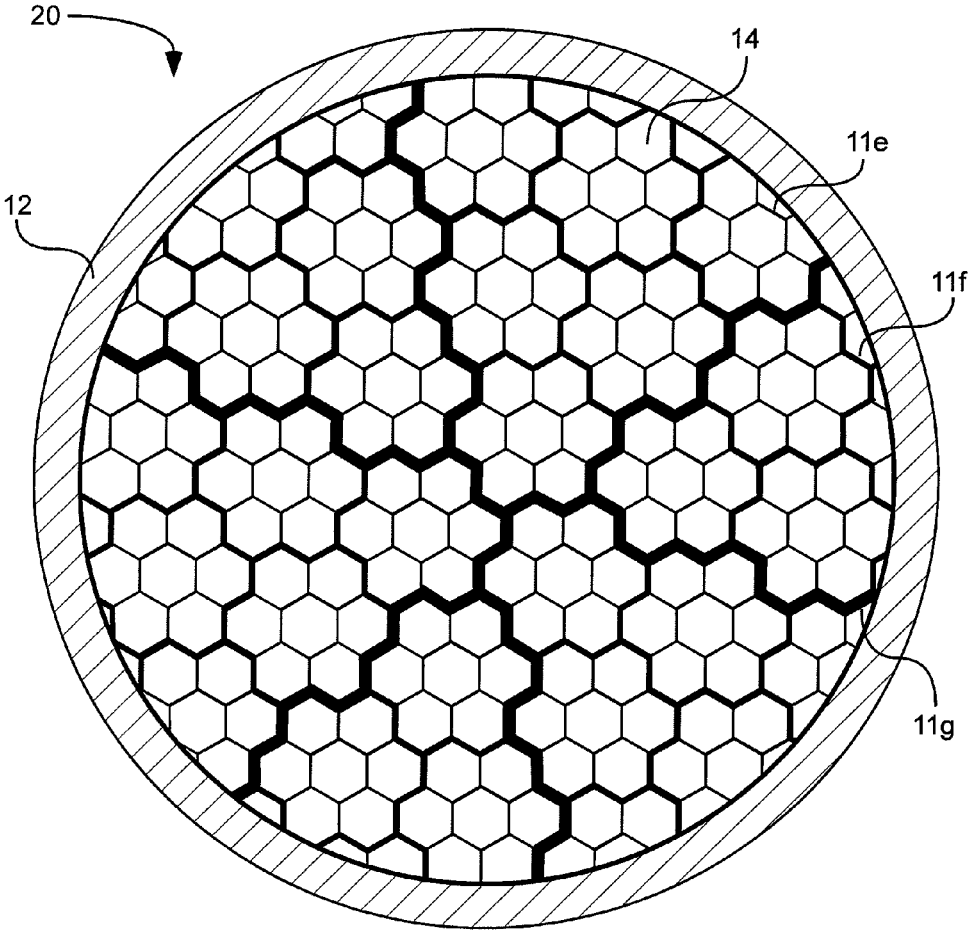
FIG. 2 is a schematic top view of an x-ray window support structure, with some ribs having a larger cross-sectional area and other ribs having a smaller cross-sectional area, in accordance with an embodiment of the present invention.

As illustrated in FIG. 2, an x-ray window 20 is shown with ribs 11*e-g* having at least three different cross-sectional areas. The smallest ribs 11*e* are formed into repeating hexagonal shapes and define hexagonal-shaped openings. The next larger ribs 11*f* are formed into repeating structures comprising seven of the small hexagonal shapes. The pattern of the larger ribs 11*f* can be aligned with the part of the hexagonal pattern of the smaller sized ribs 11*e*.

Larger ribs 11*g* can extend across the aperture of the support frame 12 to provide extra strength to the smaller sized ribs 11*e-f*. The pattern of the larger ribs 11*g* can be aligned with part of the pattern of the smaller sized ribs 11*e-f*. The ribs 11*e-f* can extend non-linearly across the aperture of the support frame 12.

Figure 3:
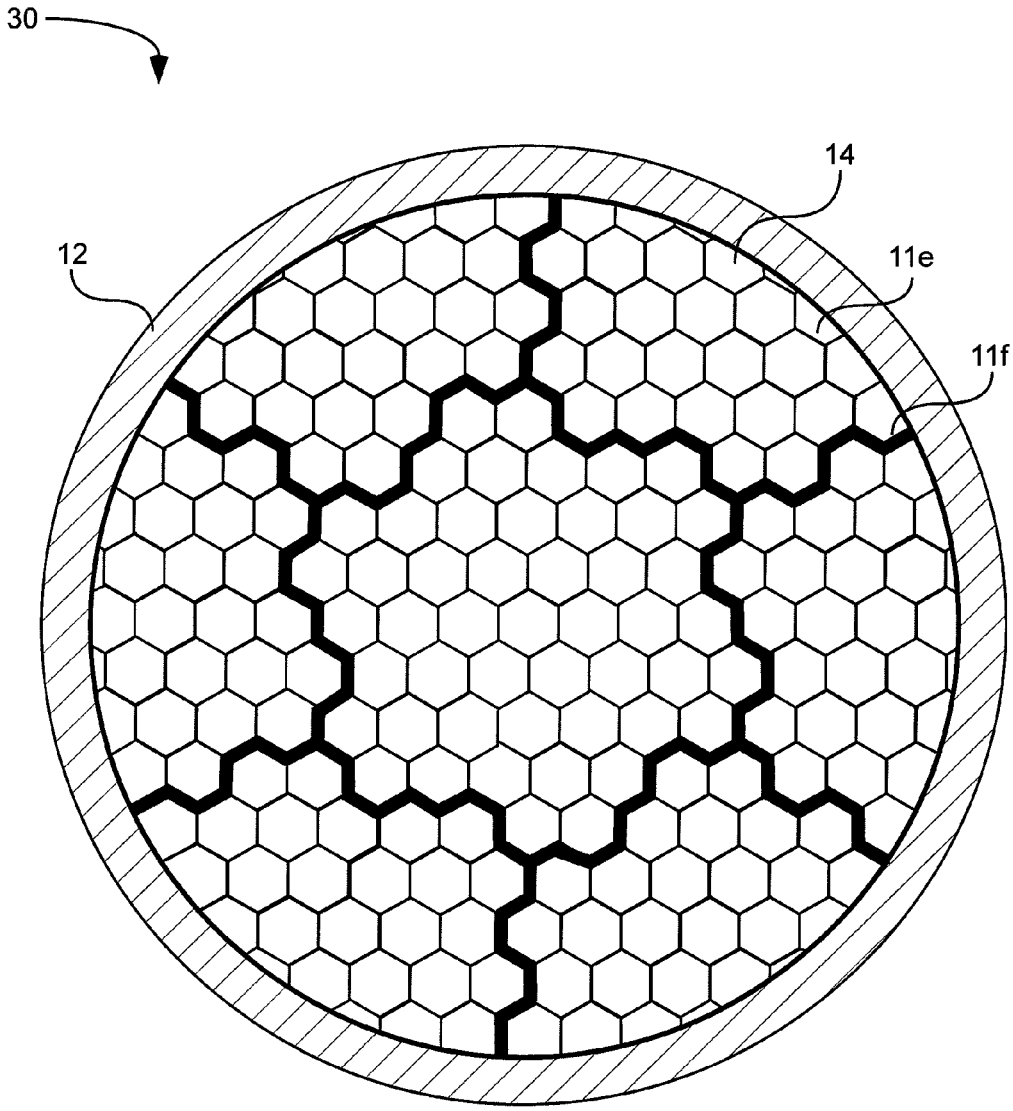
FIG. 3 is a schematic top view of an x-ray window support structure, with some ribs having a larger cross-sectional area and other ribs having a smaller cross-sectional area, in accordance with an embodiment of the present invention.

As illustrated in FIG. 3, an x-ray window 30 is shown with ribs 11*e-f* having at least two different cross-sectional areas. The smallest ribs 11*e* are formed into repeating hexagonal shapes and define hexagonal-shaped openings. The larger ribs 11*f* provide extra strength to the smaller sized ribs 11*e*. The ribs 11*e-f* can extend non-linearly across the aperture of the support frame 12. The pattern of the larger ribs 11*f* can be aligned with part of the hexagonal pattern of the smaller sized ribs 11*e*.

Figure 4:
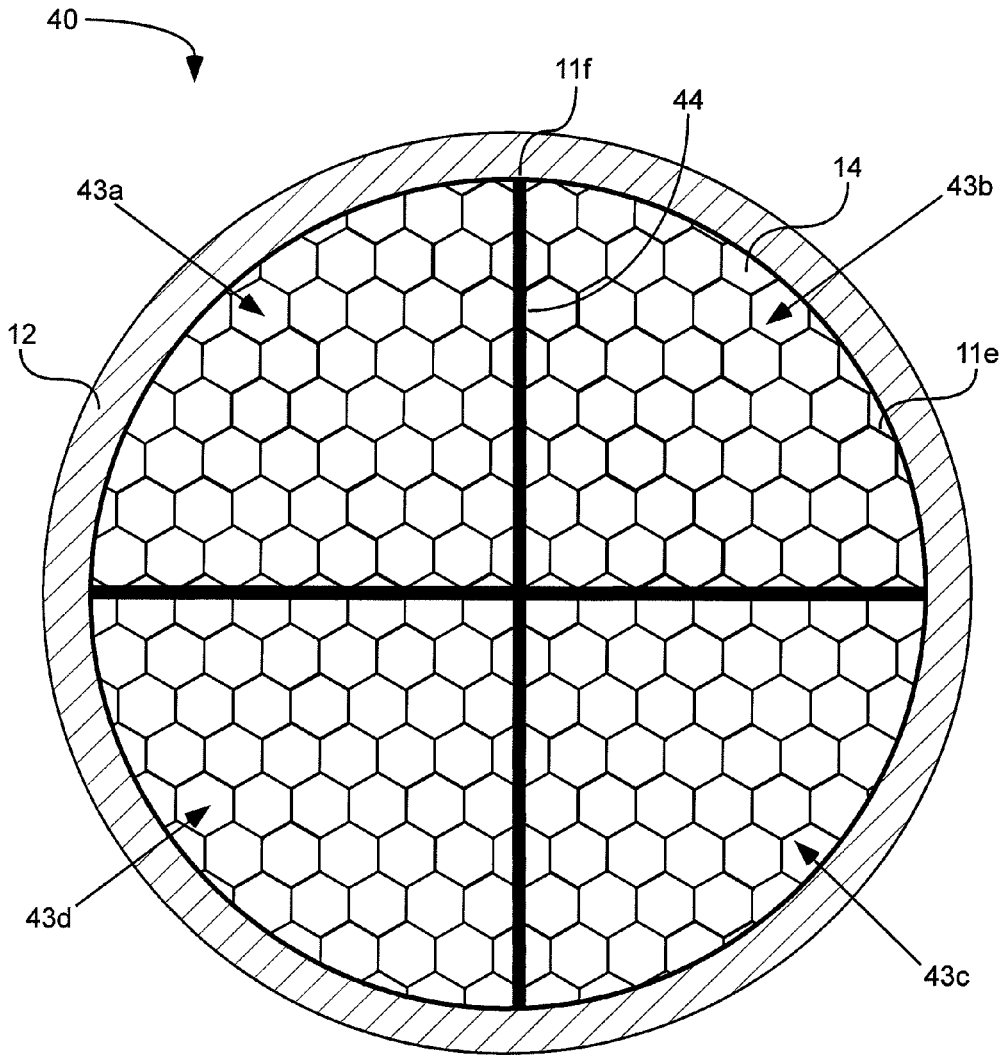
FIG. 4 is a schematic top view of an x-ray window support structure, with some ribs having a larger cross-sectional area and other ribs having a smaller cross-sectional area, in accordance with an embodiment of the present invention.

As illustrated in FIG. 4, an x-ray window 40 is shown with ribs 11*e-f* having at least two different cross-sectional areas. The smallest ribs 11*e* are formed into repeating hexagonal shapes and define hexagonal-shaped openings. The larger ribs 11*f* extend across the aperture of the support frame 12, in a cross-shape, to provide extra strength to the smaller sized ribs 11*e*. The larger-sized ribs 11*f*, along with the support frame, separate the smaller sized ribs 11*e* into separate and discrete sections 43*a-d*. Note that the smaller sized ribs 11*e* extend non-linearly across the aperture of the support frame 12 while larger sized ribs 11*f* extend linearly across the support frame 12. A portion of the pattern of the larger sized ribs 11*f* can be aligned with a portion of a pattern of the smaller sized ribs 11*e*, such as at location 44. This alignment can optimize strength by continuing with the larger ribs 11*f*, a portion of a pattern of the smaller ribs 11*e*.

Figure 5:
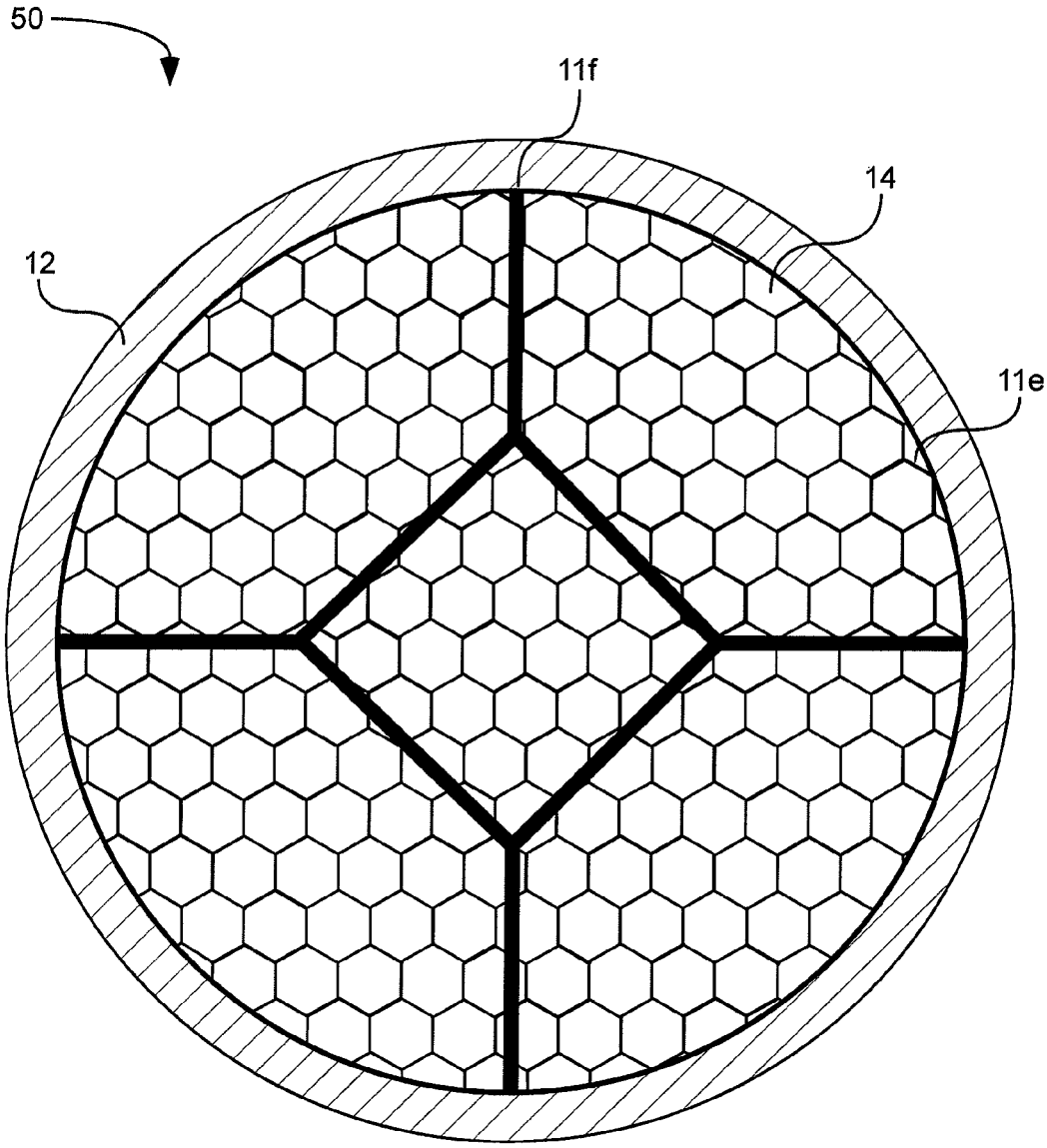
FIG. 5 is a schematic top view of an x-ray window support structure, with some ribs having a larger cross-sectional area and other ribs having a smaller cross-sectional area, in accordance with an embodiment of the present invention.

As illustrated in FIG. 5, an x-ray window 50 is shown with ribs 11*e-f* having at least two different cross-sectional areas and defining hexagonal-shaped openings. The smallest ribs 11*e* are formed into repeating hexagonal shapes. The larger ribs 11*f* extend across the aperture of the support frame 12 to provide extra strength to the smaller sized ribs 11*e*. The ribs 11*e-f* can extend non-linearly across the aperture of the support frame 12.

Figure 6:
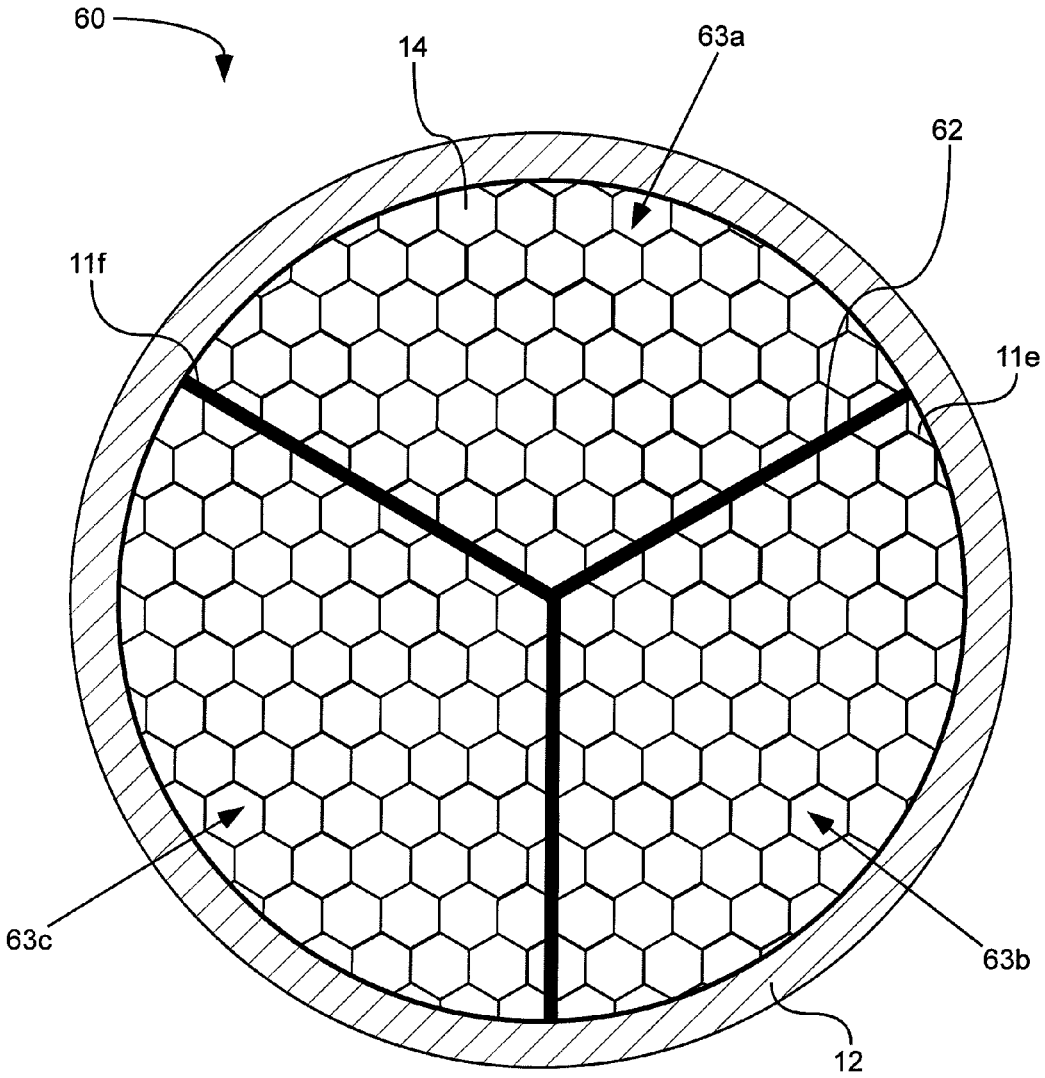
FIG. 6 is a schematic top view of an x-ray window support structure, with some ribs having a larger cross-sectional area and other ribs having a smaller cross-sectional area, in accordance with an embodiment of the present invention.

As illustrated in FIG. 6, an x-ray window 60 is shown with ribs 11*e-f* having at least two different cross-sectional areas. The smallest ribs 11*e* are formed into repeating hexagonal shapes and define hexagonal-shaped openings. The larger ribs 11*f* extend across the aperture of the support frame 12 to provide extra strength to the smaller sized ribs 11*e*. The larger-sized ribs 11*f*, along with the support frame, separate the smaller sized ribs 11*e* into separate and discrete sections 63*a-c*. The ribs 11*e-f* can extend non-linearly across the aperture of the support frame 12.

Figure 7:
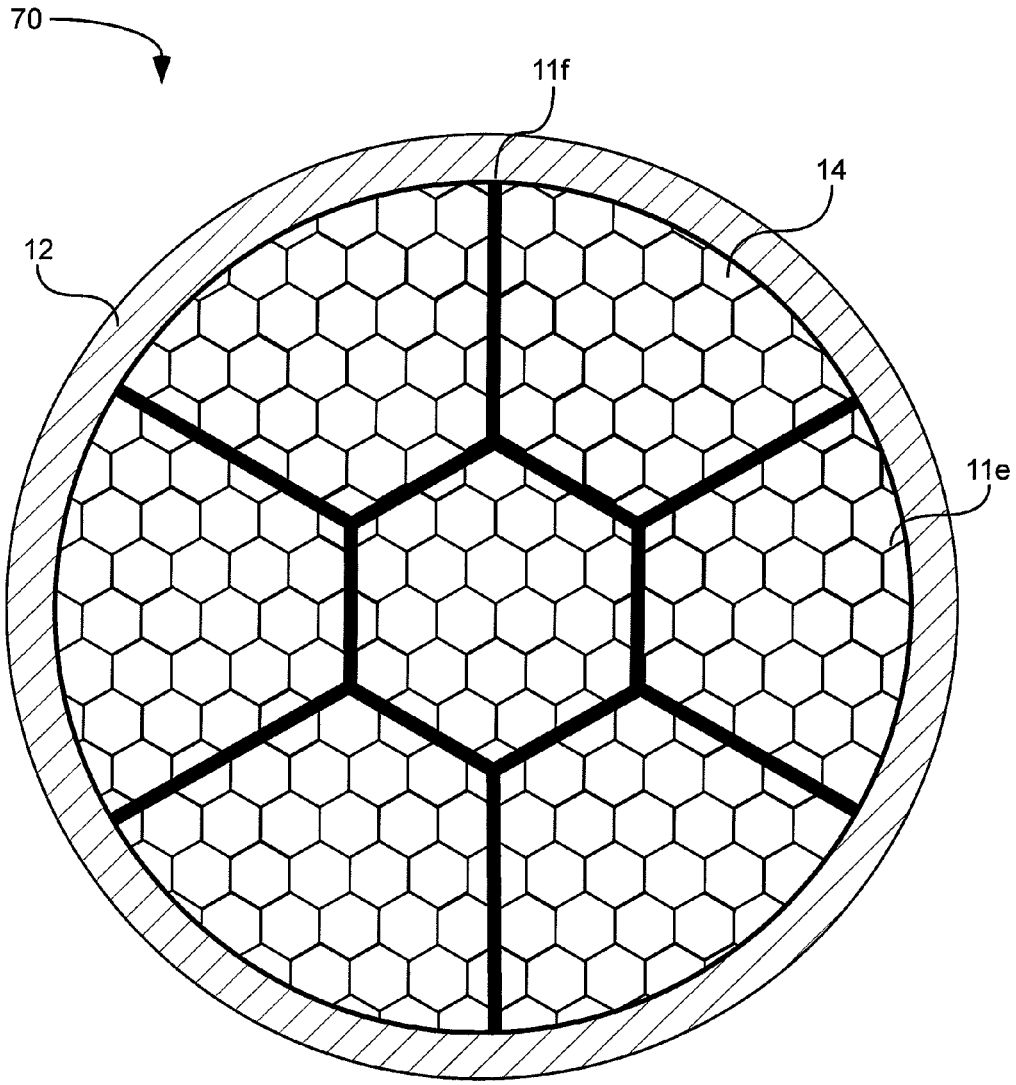
FIG. 7 is a schematic top view of an x-ray window support structure, with some ribs having a larger cross-sectional area and other ribs having a smaller cross-sectional area, in accordance with an embodiment of the present invention.

As illustrated in FIG. 7, an x-ray window 70 is shown with ribs 11*e-f* having at least two different cross-sectional areas. The smallest ribs 11*e* are formed into repeating hexagonal shapes and define hexagonal-shaped openings. The larger ribs 11*f* extend across the aperture of the support frame 12 to provide extra strength to the smaller sized ribs 11*e*. The ribs 11*e-f* can extend non-linearly across the aperture of the support frame 12.

Figure 8:
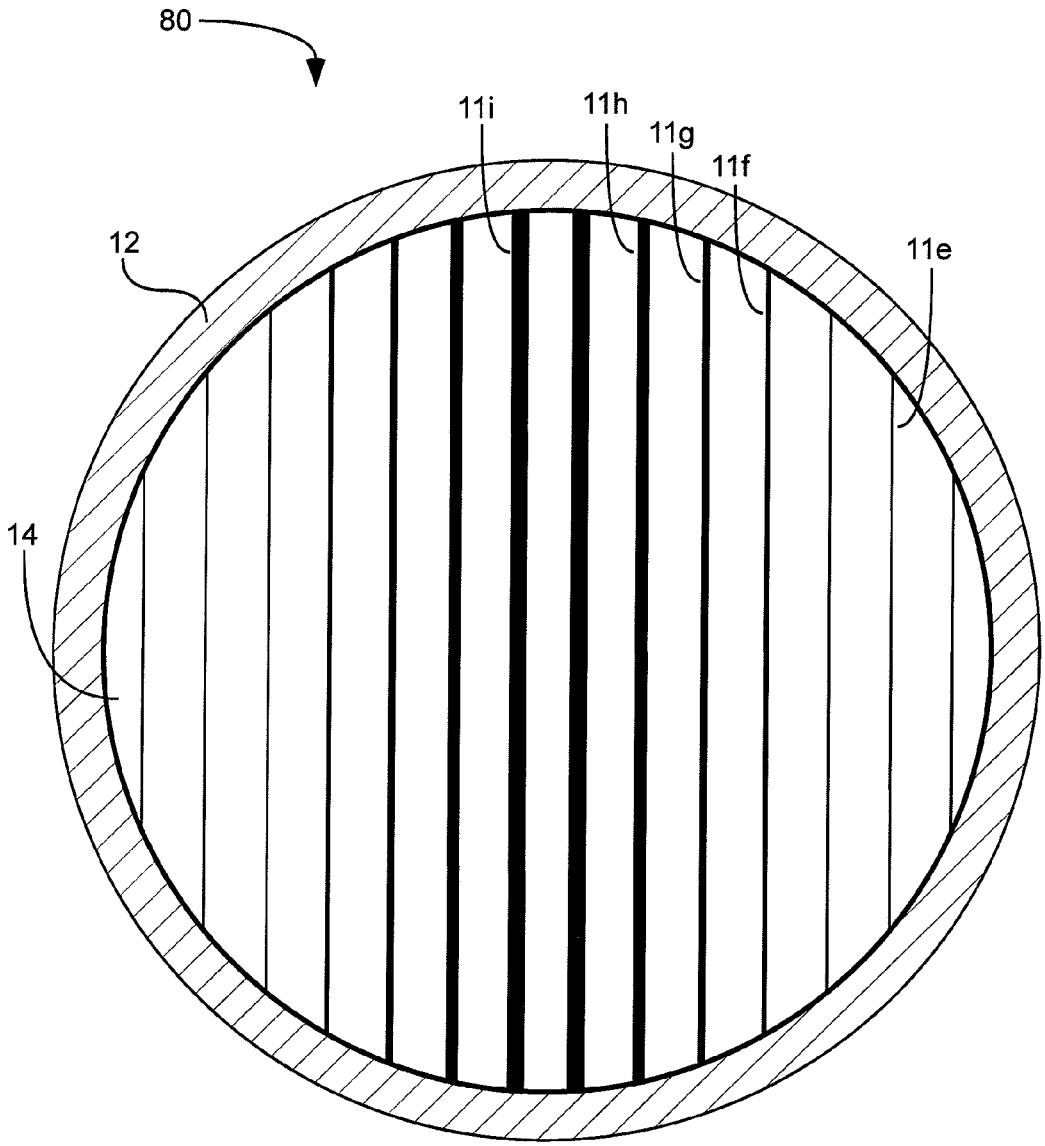
FIG. 8 is a schematic top view of an x-ray window support structure, with some ribs having a larger cross-sectional area and other ribs having a smaller cross-sectional area, in accordance with an embodiment of the present invention.

As illustrated in FIG. 8, an x-ray window 80 is shown with substantially parallel ribs 11*e-i* having at least five different cross-sectional areas. The ribs 11*e-i* extend linearly from one side of the support frame to an opposing side of the support frame 12. At least one of the larger sized ribs 11*i* can have a longer length than all smaller sized ribs 11*e-h*. Also, at least one of the larger sized ribs 11*i* can span a greater distance across the aperture of the support frame 12 than all smaller sized ribs.

Figure 9:
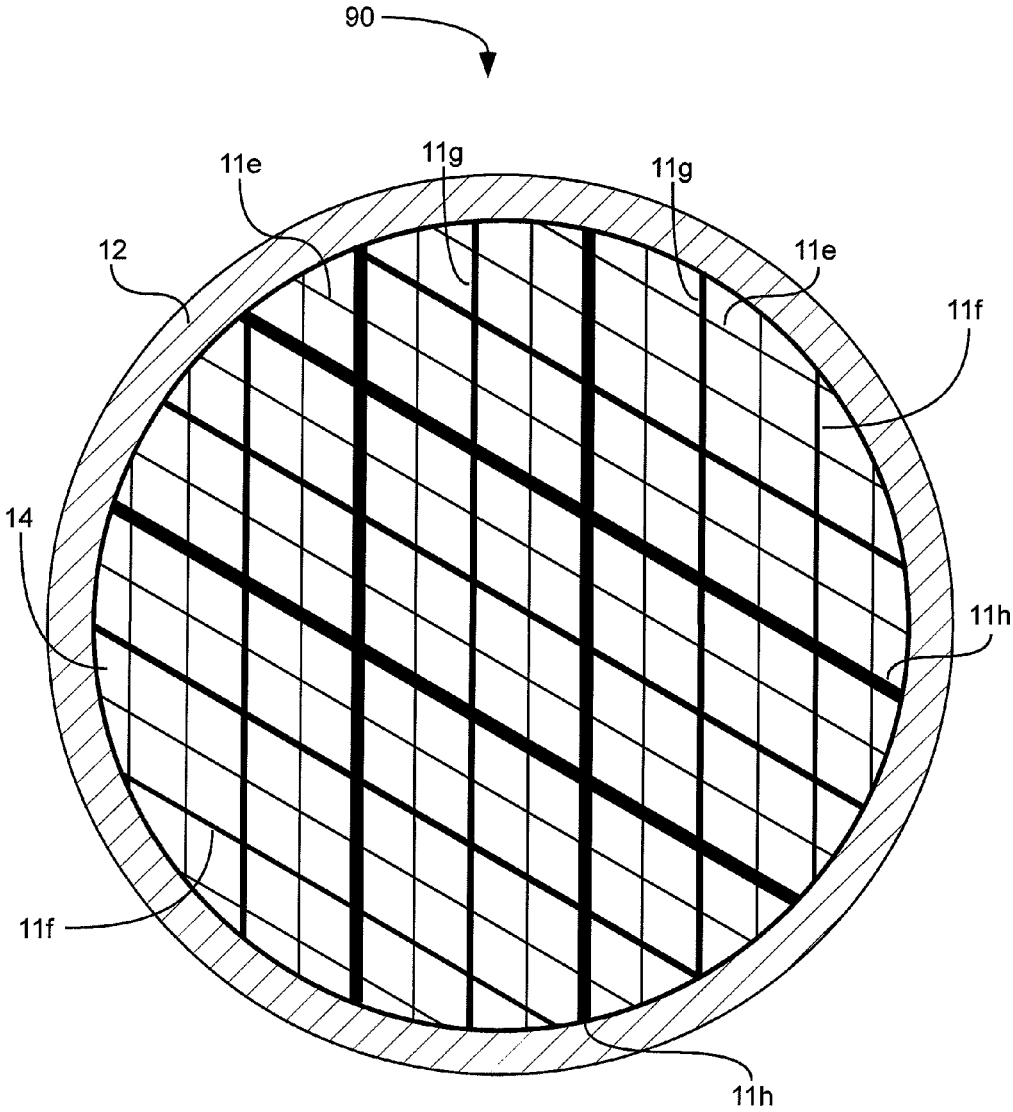
FIG. 9 is a schematic top view of an x-ray window support structure, with some ribs having a larger cross-sectional area and other ribs having a smaller cross-sectional area, in accordance with an embodiment of the present invention.

As illustrated in FIG. 9, an x-ray window 90 is shown with ribs 11*e-h* having at least four different cross-sectional areas. Some of the ribs 11*e-h* are substantially parallel with respect to each other and some of the ribs 11*e-h* ribs intersect one another. The intersecting ribs 11*e-h* can be oriented non-perpendicularly with respect to each other and can define non-rectangular openings 14.

Figure 10:
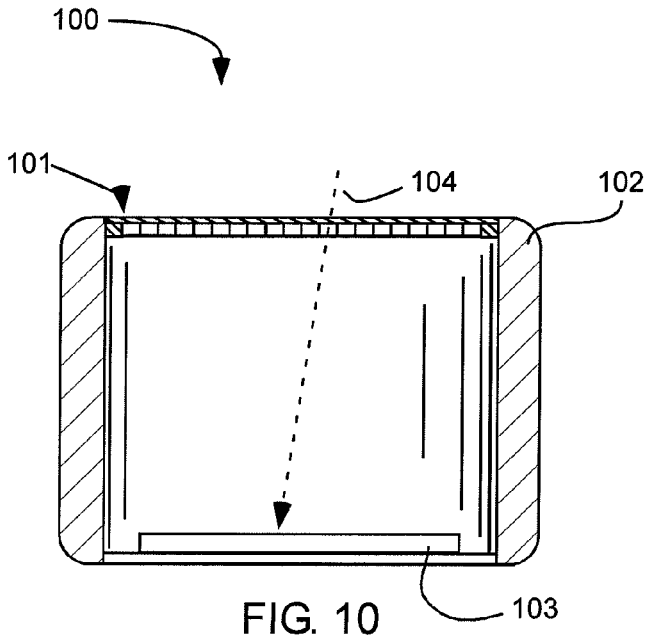
FIG. 10 is a schematic cross-sectional side view of an x-ray detector and x-ray window, in accordance with an embodiment of the present invention.

As illustrated in FIG. 10, an x-ray detection system 100 is shown comprising an x-ray window 101 hermetically sealed a mount 102. The x-ray window 101 can be one of the various x-ray window embodiments described herein. An x-ray detector 103 can also be attached to the mount 102. The window 101 can be configured to allow x-rays 104 to impinge upon the detector 103. This may be accomplished by selection of window materials and support structure size to allow for transmission of x-rays and orienting the window 101 and detector 103 such that x-rays 104 passing through the window 101 will impinge upon the detector 103.

Figure 11:
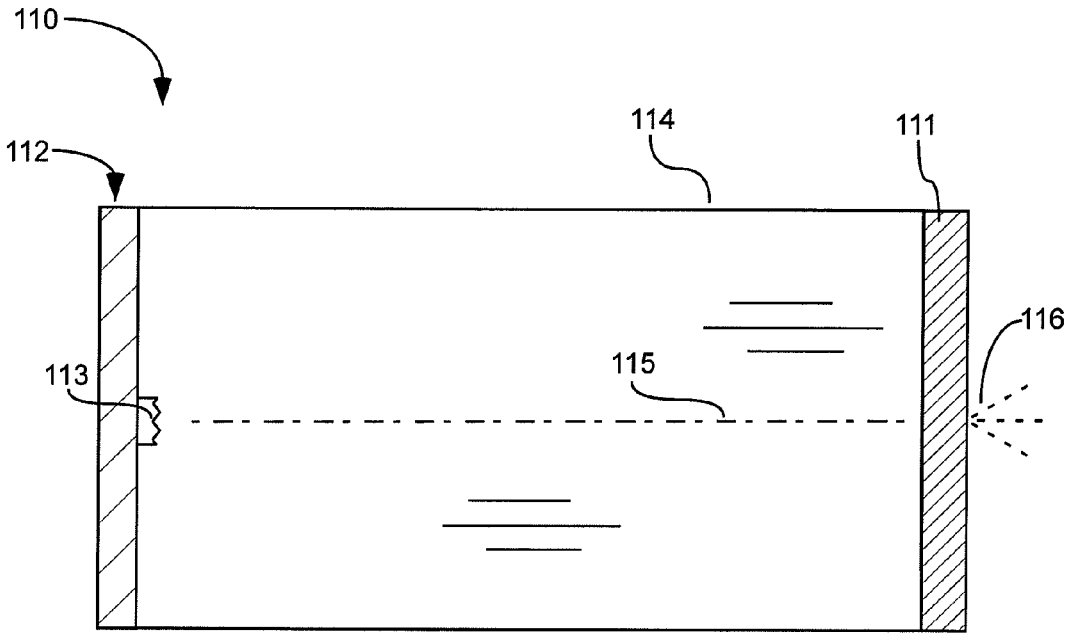
FIG. 11 is a schematic cross-sectional side view of an x-ray tube and x-ray window, in accordance with an embodiment of the present invention.

As illustrated in FIG. 11, an x-ray source 110 is shown comprising a hermetically sealed enclosure formed by an x-ray window 111, an x-ray tube 114, a cathode 112, and possibly other components not shown. An electron emitter 113 can emit electrons 115 towards the window 111 and the window 111 can be configured to emit x-rays 116 in response to impinging electrons, the x-rays 116 can exit the x-ray source 110. The x-ray window 111 can be one of the various x-ray window embodiments described herein and can have a coating of target material, such as silver or gold, to allow for production of the desired energy of x-rays 116.

Figure 12:
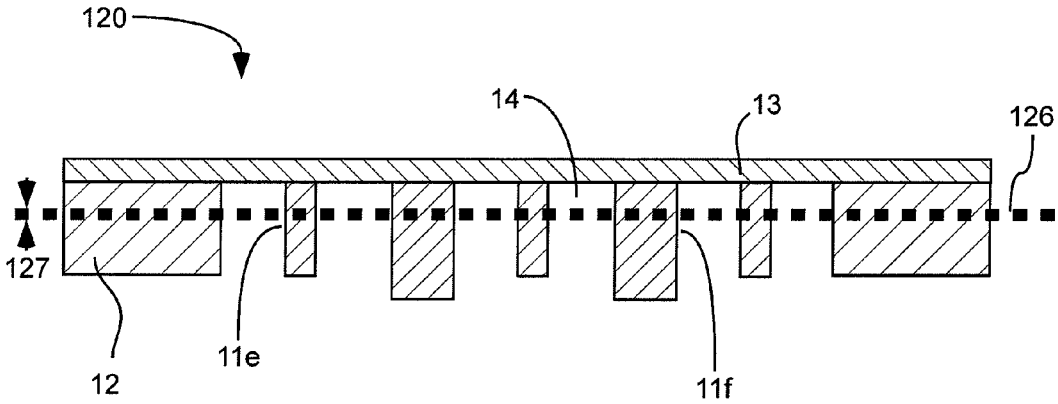
FIG. 12 is schematic cross-sectional side view of an x-ray window, showing a thin film supported by a support structure, in accordance with an embodiment of the present invention.

As illustrated in FIG. 12, an x-ray window 120 is shown with a portion of the support frame 12 and a portion of the ribs 11 all disposed in a single plane 126. The plane 126 can be substantially parallel with the film 13 and can have a thickness 127 of less than 5 micrometers.

How to Make:

The film 13 can be comprised of a material that will result in minimal attenuation of x-rays and/or minimal contamination of the x-ray signal passed through to an x-ray detector or sensor. The film can be comprised of a polymer, graphene, diamond, beryllium, or other suitable material. The window can have a gas barrier film layer disposed over the film. The gas barrier film layer can comprise boron hydride. The film can be attached to the support structure by an adhesive.

The support structure can be comprised of a polymer (including a photosensitive polymer such as a photosensitive polyimide), silicon, graphene, diamond, beryllium, carbon composite, or other suitable material. The support structure can be formed by pattern and etch, ink jet printer or inkjet technology, or laser mill or laser ablation.

In one embodiment, ribs can have a width w between 25 μm and 75 μm and a height h between 25 μm and 75 μm.

In one embodiment, largest ribs can have a width w between about 50 μm and about 250 μm. In another embodiment, smallest ribs can have a width w between about 8 μm and about 30 μm. In another embodiment, intermediate sized ribs can have a width w between about 20 μm and about 50 μm. All ribs in this described in this paragraph can have the same height h or they can be different heights h. All ribs in this described in this paragraph can have heights h as described in the following paragraph.

In one embodiment, largest ribs can have a height h between about 20 μm and about 300 μm. In another embodiment, smallest ribs can have a height h between about 20 μm and about 60 μm. In another embodiment, intermediate sized ribs can have a height h between about 20 μm and about 100 μm. All ribs in this described in this paragraph can have the same width w or they can be different widths. All ribs in this described in this paragraph can have widths as described in the previous paragraph.

In one embodiment, openings 14 between the ribs 11 can take up about 81% to about 90% of a total area within the aperture of the support frame 12. In another embodiment, openings 14 between the ribs 11 can take up about 71% to about 80% of a total area within the aperture of the support frame 12. In another embodiment, openings 14 between the ribs 11 can take up about 91% to about 96% of a total area within the aperture of the support frame 12. Opening 14 area can be dependent on the width w and height h of the ribs 11, the pattern of the ribs, and the number of different sizes of ribs.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A window for allowing transmission of x-rays, comprising:

a) a support frame defining a perimeter and an aperture;

b) a plurality of ribs extending across the aperture of the support frame and carried by the support frame;

c) openings between the plurality of ribs;

d) a film disposed over, carried by, and spanning the plurality of ribs and openings and configured to pass radiation therethrough;

e) the plurality of ribs having at least two different cross-sectional sizes including at least one larger sized rib and at least one smaller sized rib;

f) the at least one larger sized rib has a widthwise cross-sectional area across the aperture of the support frame that is at least 5% larger than a widthwise cross-sectional area of the at least one smaller sized rib; and g) the window being hermetically sealed to an enclosure configured to enclose an x-ray source or detection device in order to separate air from a vacuum within the enclosure.

2. The window of claim 1, wherein the at least one larger sized rib has a cross-sectional area that is at least 50% larger than a cross-sectional area of the at least one smaller sized rib.

3. The window of claim 1, wherein the at least one larger sized rib has a cross-sectional area that is at least twice as large as a cross-sectional area of the at least one smaller sized rib.

4. The window of claim 1, wherein the plurality of ribs include at least three different sizes and each larger size has a cross-sectional area that is at least 5% larger than a cross-sectional area of a smaller sized rib.

5. The window of claim 1, wherein the plurality of ribs include at least four different sizes and each larger size has a cross-sectional area that is at least 5% larger than a cross-sectional area of a smaller sized rib.

6. The window of claim 1, wherein the plurality of ribs form multiple hexagonal-shaped structures and define hexagonal-shaped openings.

7. The window of claim 1, wherein the plurality of ribs extend from one side of the support frame to an opposing side and are substantially parallel with respect to each other.

8. The window of claim 1, wherein the plurality of ribs intersect one another.

9. The window of claim 8, wherein the plurality of ribs are oriented non-perpendicularly with respect to each other and define non-rectangular openings.

10. The window of claim 1, wherein at least one larger sized rib has a longer length than all smaller sized ribs.

11. The window of claim 1, wherein at least one larger sized rib spans a greater distance across the aperture of the support frame than all smaller sized ribs.

12. The window of claim 1, wherein the plurality of ribs extend non-linearly across the aperture of the support frame.

13. The window of claim 1, wherein the at least one larger sized rib along with the support frame separate the at least one smaller sized rib into separate and discrete sections.

14. The window of claim 1, wherein tops of the plurality of ribs terminate substantially in a common plane.

15. The window of claim 1, wherein a pattern of the at least one larger sized rib is aligned with a portion of a pattern of the at least one smaller sized rib.

16. The window of claim 1, wherein a portion of a pattern of the at least one larger sized rib is aligned with a portion of a pattern of the at least one smaller sized rib.

17. The window of claim 1, wherein the at least one larger sized rib has a larger width than the at least one smaller sized rib.

18. The window of claim 1, wherein a portion of the support frame and a portion of the plurality of ribs are disposed in a single plane, having a thickness of less than 5 micrometers, which is substantially parallel with the film.

19. The window of claim 1, wherein the film contacts the plurality of ribs.

20. The window of claim 1, wherein:

a) the window is hermetically sealed to a mount;

b) the mount is attached to an x-ray detector; and c) the window is configured to allow x-rays to impinge upon the detector.

21. The window of claim 1, wherein:

a) the window is hermetically sealed to an enclosure including an x-ray source, the enclosure being partially formed by the window and an x-ray tube; and b) the window is configured to allow x-rays to exit the x-ray source.

22. The window of claim 1, wherein the cross-section of the at least one larger sized rib extends along an entire length of the at least one larger sized rib.

23. The window of claim 1, wherein a larger cross-section of the at least one larger sized rib is larger than a smaller cross-section of the at least one smaller sized rib along a majority of a length of the at least one smaller sized rib across the aperture of the support frame.

24. The window of claim 1, wherein the at least one smaller sized rib has a smaller cross-section along at least a majority of a length of the at least one smaller sized rib across the aperture of the support frame.

25. A window for allowing transmission of x-rays, comprising:

a) a support frame defining a perimeter and an aperture;

b) a plurality of ribs extending across the aperture of the support frame and carried by the support frame, the plurality of ribs having openings therebetween;

c) the plurality of ribs having tops that terminate substantially in a common plane;

d) a film disposed over and spanning the plurality of ribs and openings and configured to pass radiation therethrough;

e) the plurality of ribs having at least two different cross-sectional sizes including at least one larger sized rib and at least one smaller sized rib;

f) the at least one larger sized rib has a widthwise cross-sectional area across the aperture of the support frame that is at least 50% larger than a widthwise cross-sectional area across the aperture of the support frame of the at least one smaller sized rib;

g) the at least one larger sized rib has a longer length than all of the smaller sized ribs;

h) the at least one larger sized rib spans a greater distance across an aperture of the support frame than at least one of the smaller sized ribs; and i) the window being hermetically sealed to an enclosure configured to enclose an x-ray source or detection device in order to separate air from a vacuum within the enclosure.

26. A window for allowing transmission of x-rays, the window comprising:

a) a support frame defining a perimeter and an aperture;

b) a plurality of ribs extending across the aperture of the support frame and carried by the support frame, the plurality of ribs having openings therebetween;

c) the plurality of ribs terminate substantially in a common plane;

d) a film disposed over and spanning the plurality of ribs and openings and configured to pass radiation therethrough;

e) the plurality of ribs having at least two different cross-sectional sizes including at least one larger sized rib and at least one smaller sized rib;

f) the at least one larger sized rib has a widthwise cross-sectional area that is at least 5% larger than a widthwise cross-sectional area of the at least one smaller sized rib, a larger widthwise cross-section of the at least one larger sized rib extending across the aperture of the support frame and along an entire length of the at least one larger sized rib, a smaller widthwise cross-section of the smaller sized rib being smaller along at least a majority of a length of the at least one smaller sized rib across the aperture of the support frame; and g) the window being hermetically sealed to a mount, the mount being further hermetically sealed to either an x-ray source or a detector in order to form a hermetically sealed enclosure.

* * * * *